United States Patent [19]

Deike

[11] 3,939,563

[45] Feb. 24, 1976

[54] VISE AND PUNCH TOOL

[75] Inventor: Robert F. Deike, Cheyenne, Wyo.

[73] Assignee: Foresight Industries, Cheyenne, Wyo.

[22] Filed: Feb. 3, 1975

[21] Appl. No.: 546,326

[52] U.S. Cl. ..... 30/361; 30/16

[51] Int. Cl.[2] ..... B26F 1/02

[58] Field of Search ..... 30/358, 361, 363, 364, 30/366, 367, 368, 16; 81/5.1 R

[56] References Cited

UNITED STATES PATENTS

| | | | |
|---|---|---|---|
| 942,291 | 12/1909 | Siegrist | 30/361 |
| 1,180,357 | 4/1916 | Whitney | 30/361 |
| 1,697,960 | 1/1929 | McCullough | 30/361 X |
| 3,122,833 | 3/1964 | Houston | 30/361 |
| 3,296,696 | 1/1967 | Kamla | 30/16 |
| 3,336,825 | 8/1967 | Cashion | 81/5.1 R |

*Primary Examiner*—Al Lawrence Smith
*Assistant Examiner*—J. C. Peters
*Attorney, Agent, or Firm*—Hill, Gross, Simpson, Van Santen, Steadman, Chiara & Simpson

[57] ABSTRACT

A pliers-type tool for locking around a work piece such as a post and slidably mounting a punch which when struck by a hammer will pierce the work piece. The tool is especially adapted for embracing and gripping a highway delineator or sign post to prevent distortion thereof after the post is driven into the ground so that a hole is easily punched in the post adjacent ground level and facing traffic for forming a weakened fracture zone whereby the post will break at ground level without leaving an upstanding segment when impacted by a vehicle and is then fit for reuse by driving the broken end into the ground and then using the tool to punch a hole in the post at the new ground level thereof.

5 Claims, 4 Drawing Figures

VISE AND PUNCH TOOL

BACKGROUND OF THE INVENTION

1. Field of the Invention

This invention relates to hand tools which are easily locked on work pieces and support another tool to act on the work piece and more particularly deals with vise locking pliers slidably mounting prick punches to pierce work pieces gripped by the pliers.

2. Prior Art

Adjustable toggle actuated locking pliers or wrenches are known in the prior art such as for example in the expired William Petersen U.S. Pat. No. 2,417,013 issued Mar. 4, 1947 and the Christian Petersen U.S. Pat. No. 2,731,932 issued Jan. 24, 1956. Copies of these patents are filed herewith from which it will be readily apparent that these prior known locking pliers or wrenches only serve to grip or clamp work pieces.

SUMMARY OF THE INVENTION

The present invention now provides adjustable locking pliers or wrenches carrying other tools, such as a prick punch, to perform an operation on a work piece gripped by the pliers or wrench. Specifically, according to this invention, the jaws of an adjustable toggle actuated locking pliers have opposed semi-cylindrical gripping sleeves extending normal to the plane of the hand grips and a tubular housing extends laterally from one of the sleeves to slidably guide a prick punch adapted to be struck by a hammer to pierce a work piece embraced by the sleeves. The sleeves may be knurled or roughened to increase the frictional grip on the work piece and the punch may have a tapered piercing end and an adjustable head on the striking end to limit the extent of entry of the piercing end into the work piece thereby controlling the size of the hole formed in the work piece by the punch. The punch may be replaced with punches of variable piercing diameter.

The tools of this invention are especially useful for gripping and reinforcing upstanding highway sign or reflector tubular posts against deformation while forming a weakened fracture zone therein at ground level so that in the event of impact by an on-coming vehicle the post will shear at ground level, will not leave a dangerous vehicle damaging above ground portion and is available for re-use by driving the sheared off end back into the ground and then forming the weakened fracture zone at the new ground entering level of the post. In this manner damage to the undercarriage of a vehicle and piercing of vehicle gasoline tanks by posts which bend over when impacted, is eliminated.

The adjustable locking pliers have hand grip operated clamping jaws for embracing a post forming a surrounding rigid band therearound and an adjustable toggle linkage between one of the jaws and a hand grip which locks the jaws around the post. The toggle linkage includes a lever which is slidably mounted in a hand grip having an integral jaw clamp and an adjusting screw threaded through the free end of the hand grip receiving the toggle lever provides an adjustable stop for the lever thereby determining the locked position of the jaws. When the hand grips are squeezed to set the toggle linkage the jaws are locked in work piece gripping relation until the toggle lever is depressed from its locked position by a release lever carried by the hand grip to which the lever is pinned. One of the jaws, preferably the toggle actuated jaw has a tubular housing projecting laterally therefrom and a prick punch is slidably mounted through this housing presenting an inner tapered punching end to the post gripped by the locked jaws and an outer impact head adapted to be struck by a hammer to drive the punch into the work piece. An adjustable stop nut can be threaded on the outer end of the punch to control the extent of penetration of the tapered end of the punch into the work piece and thereby control the size of the hole.

It is then an object of this invention to provide a pliers-type hand tool which will lock around a work piece and guide a prick punch for piercing the work piece.

Another object of this invention is to provide an adjustable toggle actuated pliers with fragmental cylindrical opposed sleeve jaws for surrounding a cylindrical post or pipe and slidably mounting a punch adapted to be struck by a hammer to pierce the work piece at the exact location determined by the positioning of the pliers on the work piece.

A further object of this invention is to provide an efficient tool for piercing highway delineator and sign posts just above ground level to form a fracture zine which will shear the post at ground level when impacted by a vehicle.

Another object of the invention is to increase the safety of highway delineator and sign posts by gripping the posts at ground level with a locking pliers tool and impacting a prick punch carried by the tool to pierce the post in a direction facing oncoming traffic.

A specific object of the invention is to provide an adjustable toggle locked pliers with elongated sleeve jaws normal to the plane of the hand grips of the pliers and with one of the jaws slidably mounting a prick punch to pierce a work piece surrounded by the jaws.

Other and further objects of this invention will become apparent to those skilled in this art from the following detailed description of the annexed sheet of drawings which, by way of a preferred example only, illustrates one embodiment of the invention.

DESCRIPTION OF THE PREFERRED EMBODIMENT

Figure 1:
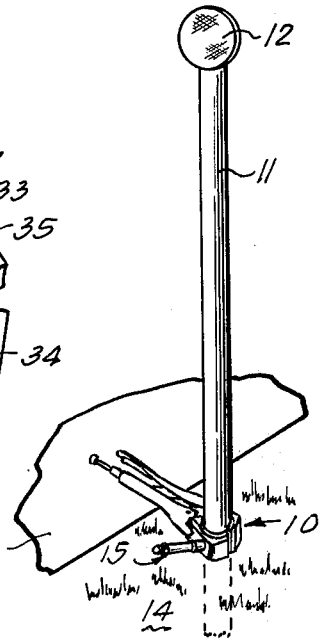
FIG. 1 is a perspective view of a highway delineator post gripped by a tool of this invention at ground level and positioning a prick punch in the direction of oncoming traffic for quickly piercing the post to form a weakened fracture zone which will shear when the post is impacted by a vehicle.

In FIG. 1 the tool 10 of this invention is illustrated as locked on a tubular post 11 carrying a reflector 12 alongside a highway 13 and anchored in the ground 14 so that a minor portion of the post length is underground while the major portion is above ground level. The tube tool 10 slidably mounts a prick punch 15 and is positioned on the post 11 just above the level of the ground 14 with the prick punch 15 extending in the direction of on-coming traffic on the highway 13.

Figure 2:
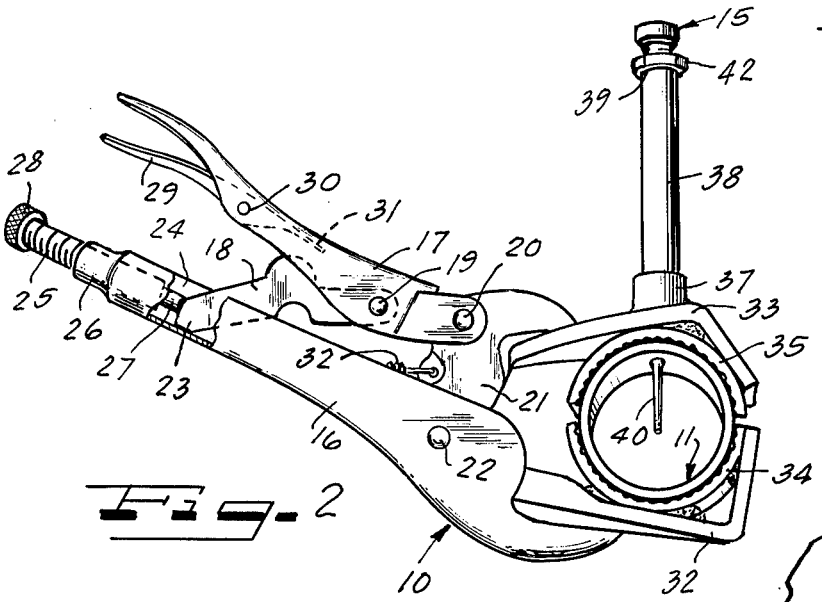
FIG. 2 is a perspective view of the tool of this invention surrounding a tubular work piece shown in cross section.
Figure 3:
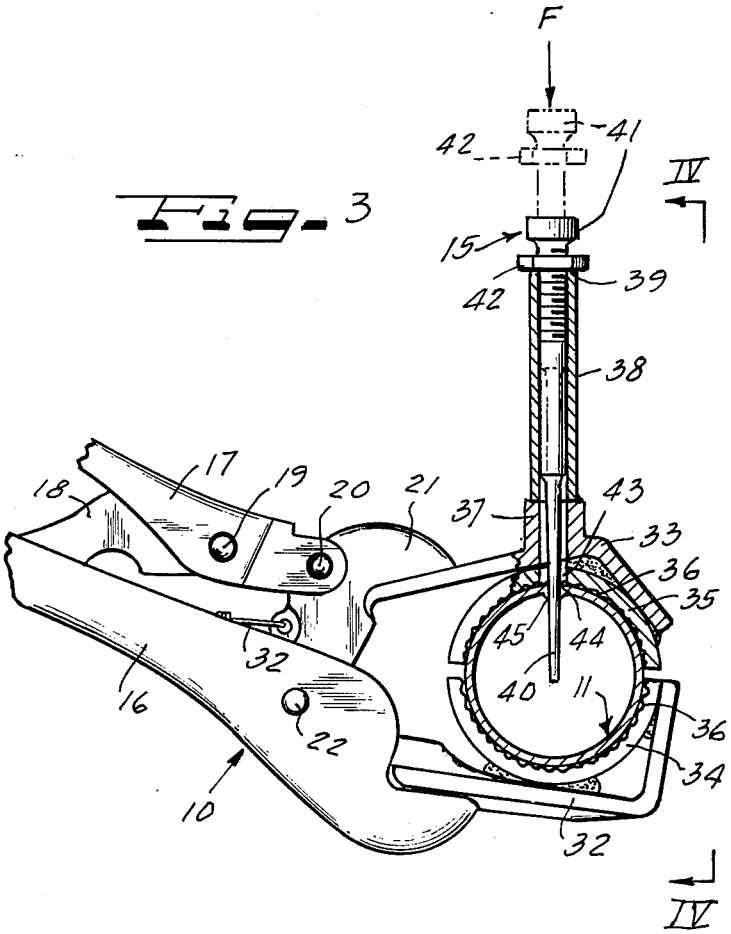
FIG. 3 is a fragmentary plan view, with parts in horizontal section of a portion of the tool of this invention embracing a tubular work piece.

As shown in FIGS. 2 and 3 the tool 10 has a pair of hand grip levers 16 and 17 in opposed relation in the same plane. The grip lever 17 has an intermediate portion pivotally pinned at 19 to one end portion of a toggle link 18 and an end portion pivotally pinned at 20 to a jaw 21 which in turn is pivotally pinned at 22 to the hand grip lever 16 near one end of this lever. The toggle link 18 has a free end 23 slidably retained in a U-shaped channel 24 in the end of the hand grip lever 16 remote from the pivot pin 22. A threaded pin 25, threaded through a cylindrical end 26 of the lever 16 provides an abutment or stop 27 for the link 18. The pin 25 has a knurled head 28 for ease in manual grasping to rotate the pin and adjust the position of the stop end 27.

The grip lever 17 is U-shaped in cross section providing a longitudinal channel receiving the link 18 and also receiving a finger 29 pivotally pinned at 30 to the lever 17. The finger 29 is adapted to be depressed to engage the end 31 thereof against an intermediate portion of the link 18 for swinging the lever 17 out of toggle locking position.

A tension spring 32 anchored in the lever 16 pulls the jaw 21 to an open or unlocked position.

The grip lever 16 fixedly mounts a C-shaped jaw 32 beyond the pin 22. An opposing C-shaped jaw 33 is fixedly mounted on the free end of the jaw 21.

Figure 4:
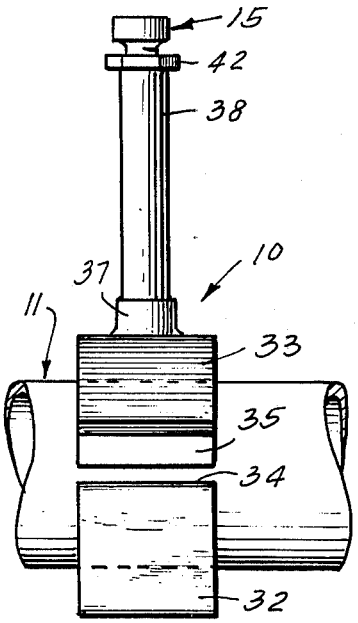
FIG. 4 is a front end elevational view of the tool and work piece taken along the line IV—IV of FIG. 3.

The jaw 32 fixedly mounts a fragmental cylindrical sleeve 34 while the jaw 33 fixedly mounts an opposing fragmental cylindrical sleeve 35. The sleeves 34 and 35 extend normal to the plane of the hand levers 16 and 17 and may be coextensive in length with the width of the jaws 32 and 33 as shown in FIG. 4. The inner peripheries of these sleeves 34 and 35 are knurled or otherwise roughened at 36. As shown, the sleeves 34 and 35 are sized to surround the post 11 with the roughened inner peripheries 36 thereof tightly engaging the outer periphery of the post.

The jaw 33 has a laterally outwardly extending nipple or boss 37 mounting a cylindrical tubular housing 38 with an open outer end 39 through which is inserted the prick punch 15 having a tapered piercing inner end 40 and a head 41 at the opposite end beyond the housing 38. A stop nut 42 is threaded on the outer end of the punch 15 under the head 41 to engage the outer open end 39 of the housing 38 and limit the penetration of the punch into the housing.

The pointed or tapered end 40 of the punch 15 is slidably guided in the housing 38 and extends freely through the nipple 37 and through an aperture 43 in the sleeve 35 to engage the post 11. When the head 41 of the punch 15 is struck by a hammer, the pointed end 40 of the punch will pierce the work piece gripped by the sleeves 34 and 35 forming a hole 44 through the work piece surrounded by a ferrule or burr 45. The sleeves 34 and 35 snugly surround and grip the post 11 reinforcing it against deformation when pierced by the punch. The stop nut 42 is positioned on the punch 15 to engage the open end 39 of the housing 38 to limit the penetration of the tapered end 40 of the punch 15 into the post 11 thereby determining the size of the hole 44 and preventing the leading end of the punch from reaching the portion of the interior of the post 11 lying diametrically opposite the hole 44.

In use, the toggle adjusting pin 25 is positioned so that its stop end 27 will engage the free end of the toggle link 18 with the sleeves 34 and 35 tightened around the post 11 just before the link 18 reaches its toggle locking position whereupon a further squeezing of the grip lever 17 will align the pivot pins 19 and 20 with the end of the link 18 and moving the toggle linkage to its locked position. Then the finger 29 may be depressed to effect relative movement between the lever 17 and the link 18 to unlock the toggle.

It will, therefore, be appreciated that the tool 10 is easily and quickly mounted on and locked to the post 11 at the exact desired position for centering the prick punch 15 and that the punch is then struck by a hammer to pierce the work piece at the exact location determined by the tool. This preferred position for highway posts as described in FIG. 1 is to lock the tool around the post immediately above ground level with the prick punch extending in the direction to face on-coming traffic on the highway 13. From the above descriptions it should thus be clear that this invention provides a convenient hand tool serving both as a vise and a punch and including an adjustable toggle actuated pliers and a prick punch slidably mounted on one of the jaws of the pliers to pierce a work piece engaged by the pliers. It will also be understood that the tool provides enlarged gripping sleeve jaws configured to intimately surround the work piece and reinforce it against distortion during the piercing operation.

I claim:

1. A vise and punch tool comprising a pair of hand grip levers, a pair of opposed jaw members controlled by said levers, an adjustable toggle linkage between one of the jaws and the hand grips locking the jaws around the work piece, said jaws having opposed enlarged sleeve portions for surrounding and gripping the work piece to prevent distortion thereof, one of said jaws having a tubular housing extending laterally therefrom, a prick punch slidably mounted in said housing adapted to penetrate a work piece surrounded by the jaw sleeves, and means limiting the penetration of the punch into the work piece.

2. In a tool having a pliers portion with hand grip operated opposed jaws and an adjustable toggle linkage between one of the jaws and the hand grips locking the jaws around a work piece, the improvements of segmental sleeves normal to the plane of the hand grips, sized to conform with and embrace a work piece to support it against distortion, a tubular housing extending laterally from one of the jaws having its interior communicating with the inner periphery of one of the sleeves, and a punch having a pointed end extending through said one jaw to pierce a work piece enveloped by the jaws and an opposite striking head end to receive a hammer blow for forcing the punch into the work piece.

3. The tool of claim 1 wherein the sleeves are semi-cylindrical and have roughened inner peripheries substantially completely enveloping a tubular work piece.

4. The tool of claim 1 wherein the prick punch has a tapered leading end and a striking trailing end and an adjustable stop member is threaded on the striking end to control the penetration of the tapered end into the work piece.

5. The tool of claim 2 wherein the jaws of the hand grips have integral C-clamps and the sleeves are welded in these clamps.

* * * * *